US005893772A

United States Patent [19]

Carmo et al.

[11] Patent Number: 5,893,772

[45] Date of Patent: Apr. 13, 1999

[54] LOCKING MECHANISM FOR AN ELECTRICAL CONNECTOR

[75] Inventors: Robert A. Carmo, Placentia; Nicholas F. Spinello, Irvine, both of Calif.

[73] Assignee: Pacific Electricord Company, Gardena, Calif.

[21] Appl. No.: 08/919,418

[22] Filed: Aug. 27, 1997

[51] Int. Cl.[6] ..... H01R 4/50

[52] U.S. Cl. ..... 439/346; 439/348

[58] Field of Search ..... 439/346, 345, 439/347, 348, 369

[56] References Cited

U.S. PATENT DOCUMENTS

| | | | |
|---|---|---|---|
| 3,389,371 | 6/1968 | Maynard | 439/682 |
| 4,664,463 | 5/1987 | Carmo | 439/369 |
| 5,129,836 | 7/1992 | Ursich | 439/346 |
| 5,393,243 | 2/1995 | Carmo | 439/369 |
| 5,551,884 | 9/1996 | Burkhart, Sr. | 439/346 |

*Primary Examiner*—Gary Paumen
*Assistant Examiner*—Antoine Ngandjui
*Attorney, Agent, or Firm*—Paul J. Sutton

[57] ABSTRACT

A female connector having a locking mechanism which can be selectively applied to permit the removal or insertion of the blades of a male plug into the female connector or retain such blades within the female connector. The female connector has two pairs of contacts each having a first end at which two contact arms are located. A projection on one of the arms is dimensioned and positioned to engage a mating hole in a plug blade. The position of the one arm with projection is controlled by an actuator assembly which is accessible from outside the female connector. When the push button of the actuator assembly is pushed, the projection is removed from the associated contact arm to permit a plug blade to be removed or enter between the contact arms. In the reset position the projections grip the plug blades making withdrawal from the female connector of the male blades difficult.

13 Claims, 15 Drawing Sheets

50

120
122
124
126
128
123
123
132
128
122
54

LOCKING MECHANISM FOR AN ELECTRICAL CONNECTOR

BACKGROUND OF THE INVENTION

1. Field of the Invention

The invention is directed to the joining together of two electrical cords and, more particularly, to a mechanism which can be incorporated into female electrical connectors to lock an inserted male connector to such female connector.

2. Description of the Prior Art

By the use of electrical extension cords, electrical devices, such as tools, lamps, appliances and the like can be used at a distance from the source of electrical power, such as a wall outlet. The electrical device has a male connector or plug which is plugged into a female connector or socket at one end of the extension cord while the male connector at the other end of the extension cord is plugged into the outlet. If the tool or appliance being used is moved during such use the device plug may be pulled free of the extension cord and thus prevent further use until the plug and socket are rejoined. Such plug/socket separation can be a major problem if the user is remote from the plug/socket joint as on a ladder, a roof or similar place.

One approach to prevent the unwanted separation of male plugs from female sockets is the use of external, mechanically operated plug and socket clamps of the type shown in U.S. Pat. No. 4,664,463 issued May 12, 1987 for "Plug and Connector Clamp" by Robert A. Carmo and U.S. Pat. No. 5,393,243 issued Feb. 28, 1995 for "Releasable Cord Connecting Lock" by Robert A. Carmo, both assigned to the instant assignee. Although these devices work well, they do require that an extra mechanism be used and that the user remember to take it along to the end of the extension cord.

U.S. Pat. Nos. 5,129,836 issued Jul. 14, 1992 and 5,281,162 issued Jan. 25, 1994, both directed to "Self-Locking Female Receptor For Electrical Cord" by Nels E. Ursich show a mechanism for locking the blades of a male plug in a housing. However, there is no disclosure as to how to use the mechanism to join a plug and socket. Further, the devices use locking balls which must be properly placed with respect to the male plug blades to lock or release such blades from the female receptor.

SUMMARY OF THE INVENTION

The instant invention overcomes the noted difficulties of the known prior art by providing a locking mechanism for an electrical connector which is incorporated into the female connector itself and does not require any external devices. A housing contains two contacts, one for each of the blades of a male plug. A first end of the contacts is bifurcated to provide arms between which the blades can be positioned. A projection extends from the interior of one of the arms to engage a hole in the male blade when this arm is urged against the blade to lock such blade in position. A push button, when pushed, operates to move the arm with the projection away from the blade, to free the projection from the blade hole and release the blade. The button is also pushed to separate the arms to admit a blade. The second end of the contacts are arranged to be crimped to the conductors of an electrical cord. It is an object of the instant invention to provide a lockable connector.

It is another object of the instant invention to provide a locking mechanism for an electrical connector.

It is yet another object of the instant invention to provide a lockable female connector which can be mechanically and electrically coupled to the blades of a male plug without external devices.

It is still another object of the instant invention to provide a lockable female connector which can be opened by pressing an exterior button and lockably closed by releasing such button.

Other objects and features of the invention will be pointed out in the following description and claims and illustrated in the accompanying drawings, which disclose, by way of example, the principles of the invention, and the best mode presently contemplated for carrying them out.

BRIEF DESCRIPTION OF THE DRAWINGS

In the drawing in which similar elements are given similar reference characters.

DESCRIPTION OF THE PREFERRED EMBODIMENT

Figure 1:
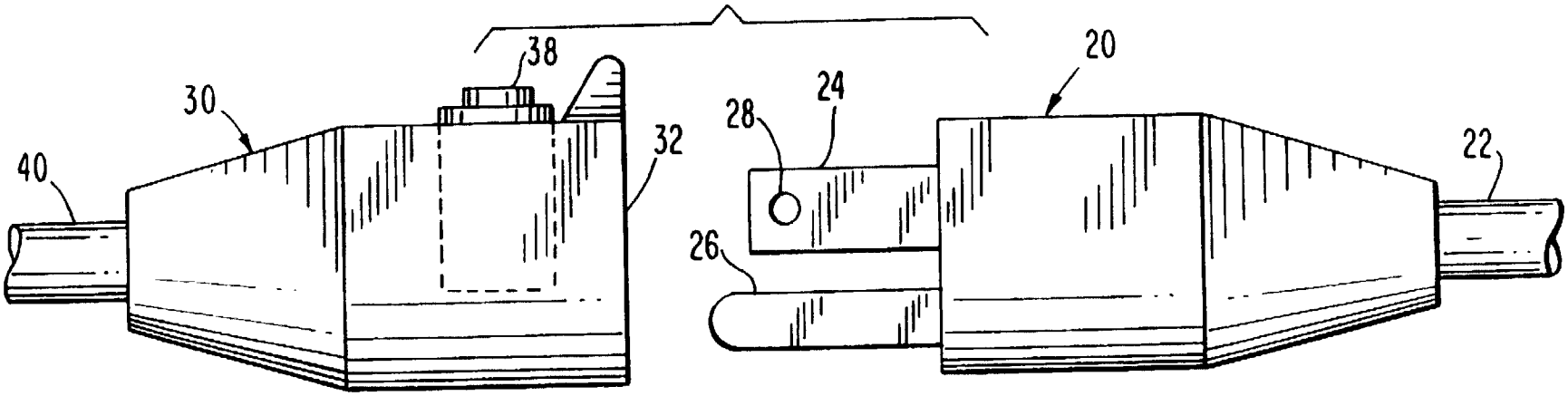
FIG. 1 is a side elevational view of a male plug to be assembled with a female connector constructed in accordance with the instant invention.
Figure 2:
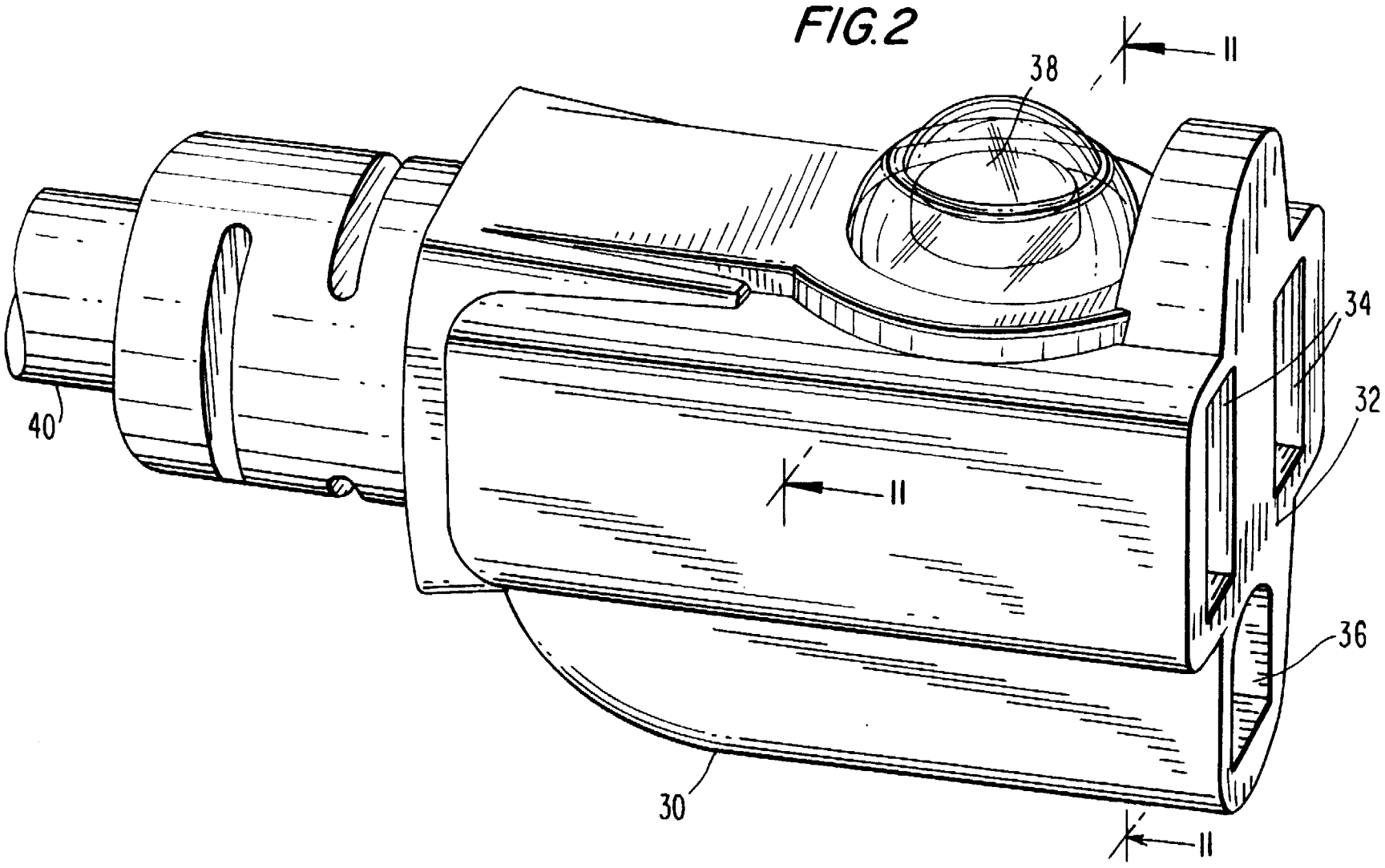
FIG. 2 is a perspective view of a female connector including a locking mechanism constructed in accordance with the concepts of the invention.

FIGS. 1 and 2 show a three contact male plug 20 in position to mate with a female connector 30 constructed in accordance with the concepts of the invention. Male plug 20 is coupled to a three conductor electrical cord 22 at one end and has two flat blades 24 (only one of which is visible in FIG. 1) and a ground pin 26 projecting from an opposite face. A locking hole 28 is placed in each of the two blades 24. The female connector 30 has an end face 32 in which are placed two slots 34 to each receive one of the blades 24 and a slot 36 to receive the ground pin 26. A button 38, employed to operate the locking mechanism, extends through the body of connector 30 where it can be engaged by the fingers of a user. The female connector 30 is coupled to a second three conductor electrical cord 40.

Figure 3:
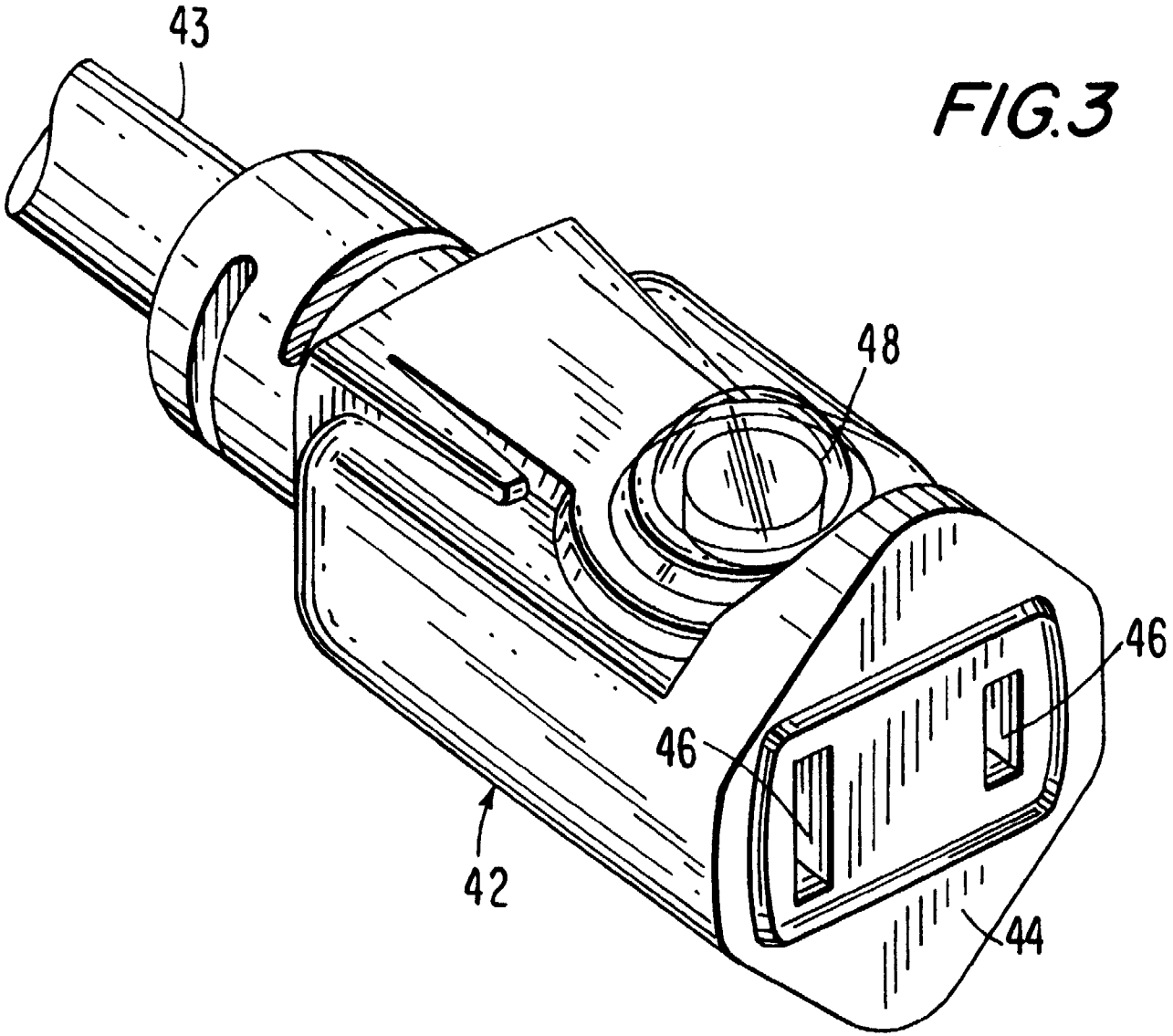
FIG. 3 is a perspective view of another female connector including a locking mechanism constructed in accordance with the concepts of the invention.

The instant invention may also be applied to a female connector 42 coupled to a two conductor electrical cord 43. Connector 42 (see FIG. 3) has an end face 44 in which are located two slots 46 each of which receives one blade of a male plug (not shown). A button 48 operates the locking mechanism of connector 42 as will be described below. The blades of the male plug will be the same as blades 24 and will have holes 28 therein. In that the grounding pin 26 and the terminal in female connector 30 are not involved with the locking mechanism, they will not be further discussed herein.

Figure 4:
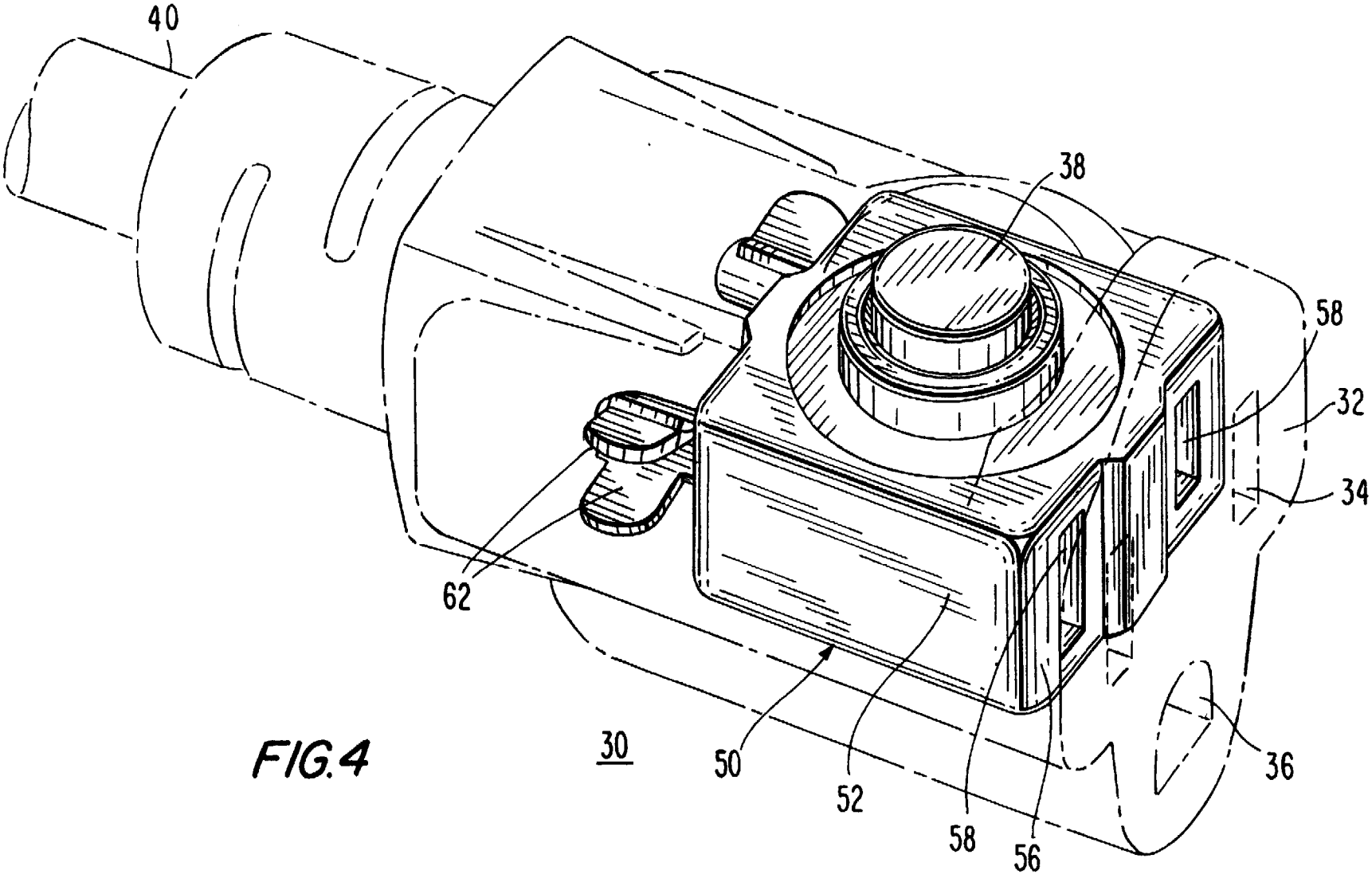
FIG. 4 is a transparent perspective view of the female connector of FIG. 2 showing the position of the locking mechanism with respect to such female connector.

FIG. 4 shows the position of the locking mechanism 50 in female connector 30. As stated above, the button 38 extends through the top surface of the upper housing portion 52 where it can be operated to open or release the locking mechanism. An end face 56 has two slots 58 each aligned with a slot 34 in end face 32 and is set at a fixed distance from the surface of end face 32. A blade 24 of a male connector 20 will extend through one of the slots 34 and into the associated slot 58 so that its hole 28 can be engaged by a projection to be described below. Extending from a rear face 60 are two sets of two connector tabs 62. Each set can be crimped to one conductor of electrical cord 40.

Figure 5:
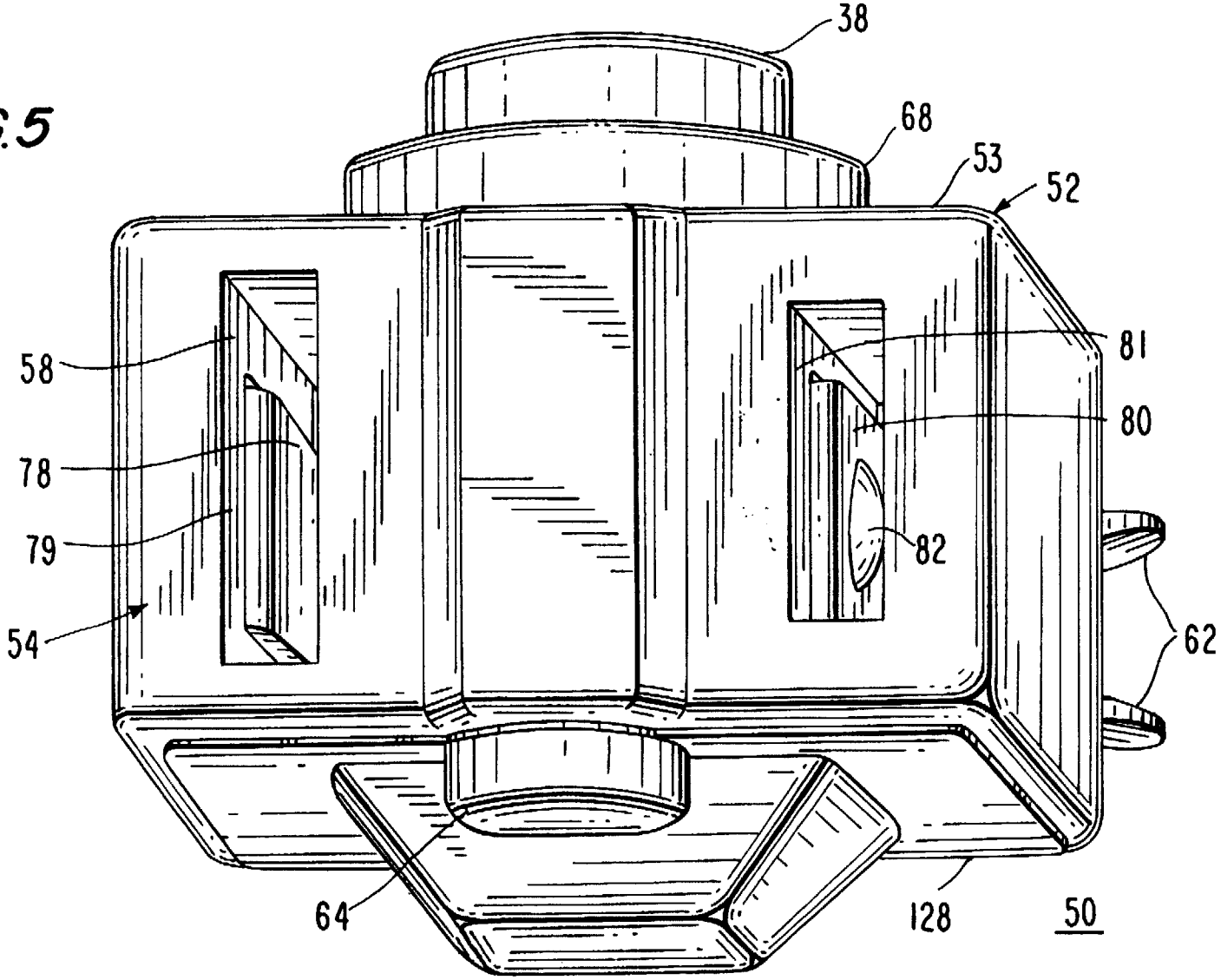
FIG. 5 is a front perspective view of a locking mechanism constructed in accordance with the concepts of the invention.
Figure 6:
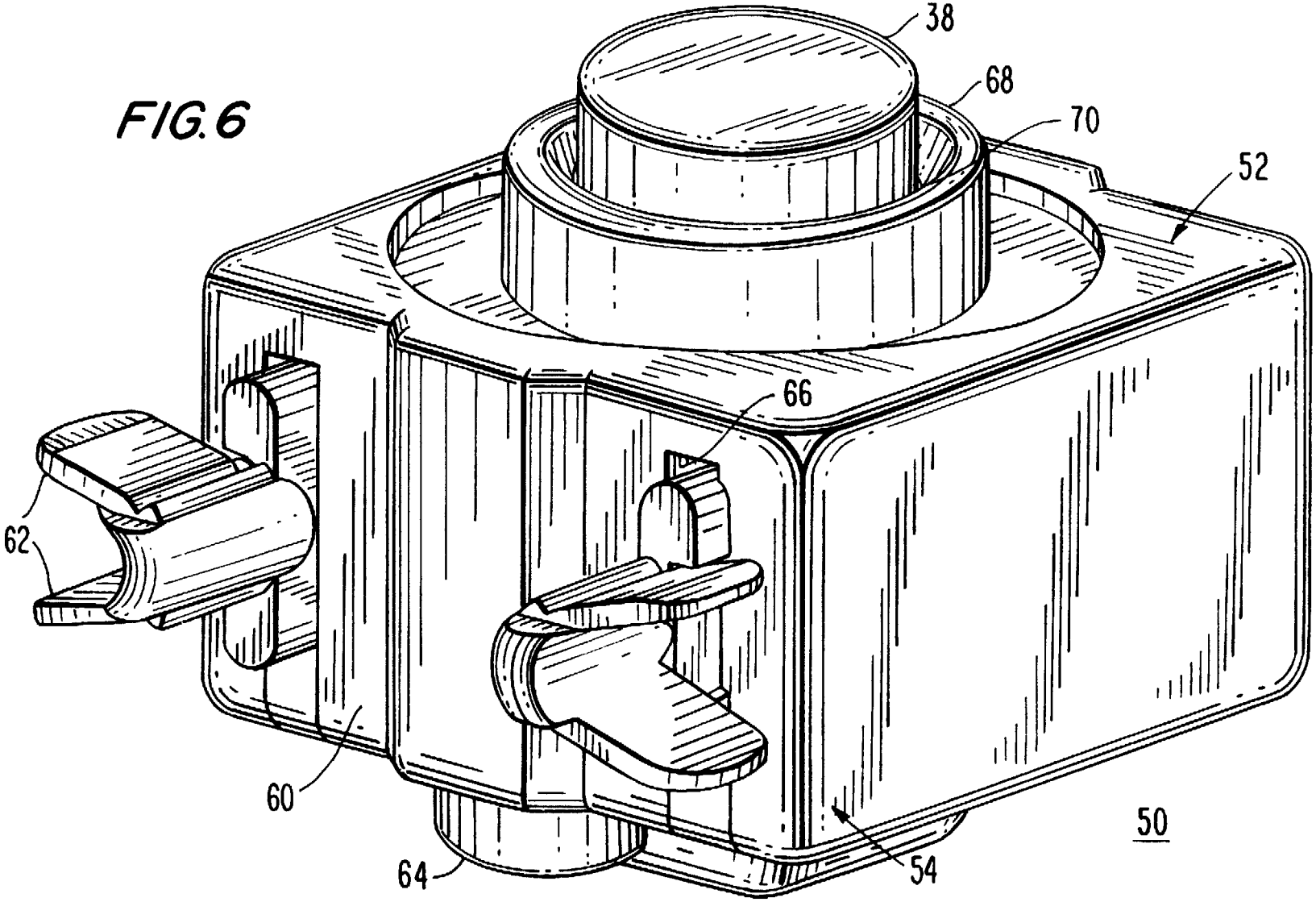
FIG. 6 is a rear perspective view of the locking mechanism of FIG. 5.

Turning now to FIGS. 5 and 6 the external details of locking mechanism 50 can be described. Locking mechanism 50 is made up of an upper housing portion 52 and a lower housing portion 54. The upper housing portion 52 is joined to the lower housing portion 54 by two screws 64 (only one of which is shown in each of the FIGS. 5 and 6). As stated above two slots 58 admit the blades 24 of male plug 20 into the contacts within the locking mechanism 50 as will be described below. These contacts have connector tabs 62 which extend through slots 66 in rear face 60. A collar 68 extends about the bore 70 in which the button 38 is placed.

Figure 7:
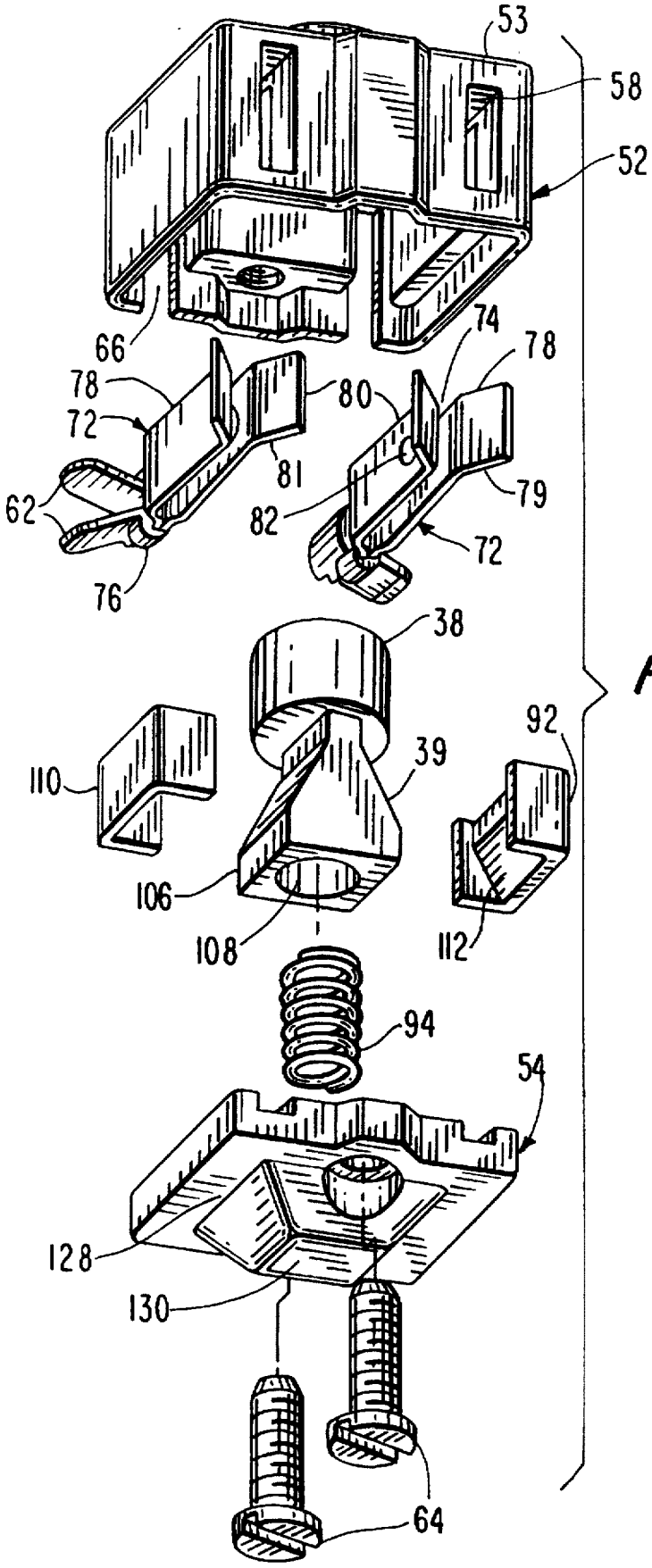
FIG. 7 is an exploded, perspective view of the locking mechanism of FIG. 5.

Referring to FIG. 7, there is shown a locking mechanism constructed in accordance with the invention in exploded form. The upper housing portion 52 contains two contacts 72 which have a blade receiving end 74 and a conductor receiving end 76 at which is located the connector tabs 62. The blade receiving ends 74 are made up of two contact arms 78, 80 joined adjacent conductor receiving end 76 and outwardly flared adjacent said blade receiving end 74 as at 79 and 81 to provide a lead-in for the inserted blades 24 of a male plug 20. For convenience of description the contact arms 78 are referred to as the outside arms while the contact arms 80 are defined as the inside arms. A bump, rib or other form of projection 82 extends from the inside arms 80 towards the outside arms 78 (see FIG. 10). The projections 82 are so placed on inside arms 80 that they can be made to engage the holes 28 in the blades 24 of an inserted male plug 20.

Figure 15:
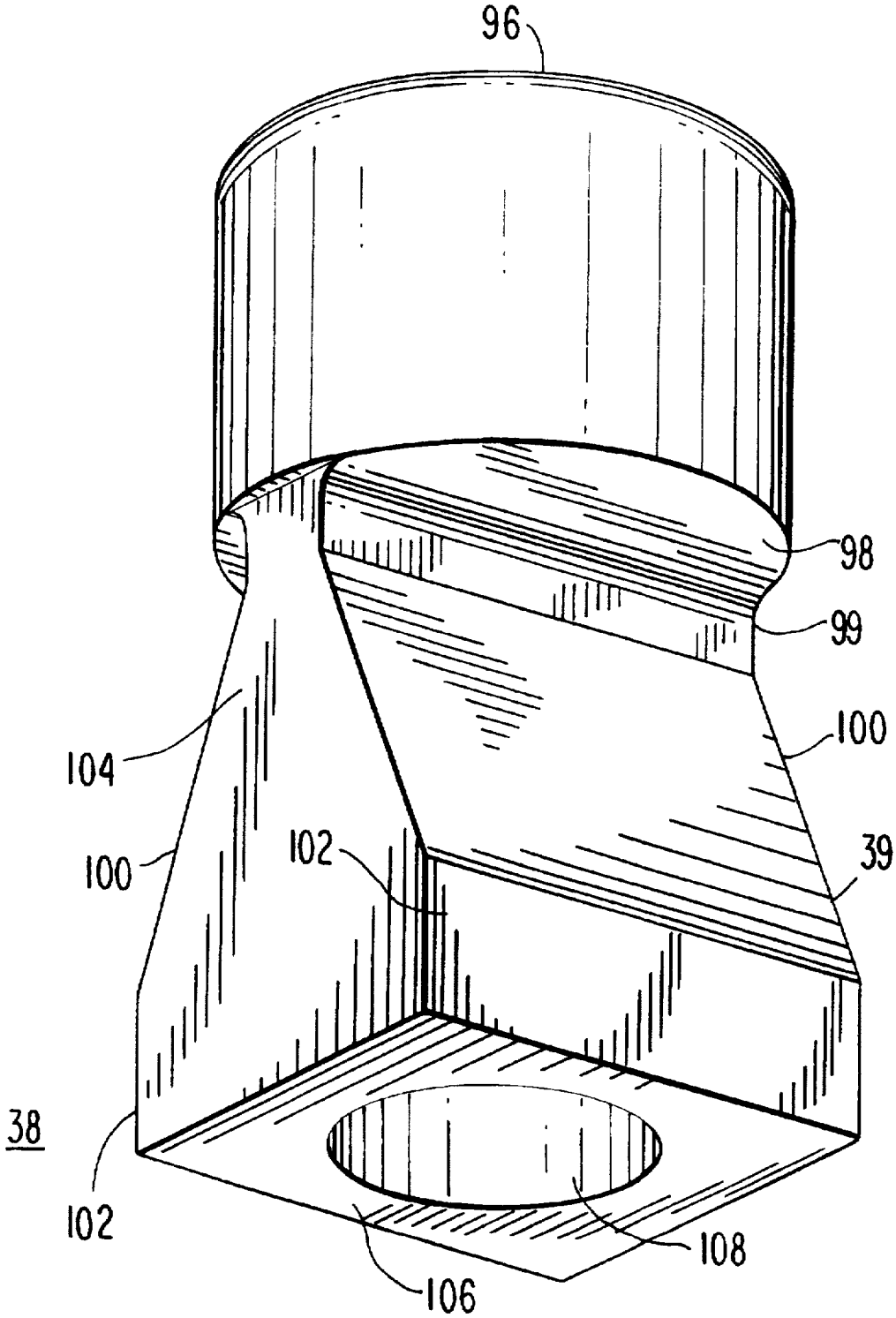
FIG. 15 is a bottom perspective view of the button mechanism of the locking mechanism of FIG. 5.

Positioned between the contacts 72 is a push button assembly 90 which comprises push button 38 at one end, a bias spring 94 at a second end and button cams 39 intermediate said ends surrounded by pusher members 92. Button 38 has a top surface 96 to be engaged by the operator. Joined to bottom surface 98 of button 38 are button cams 39 (see FIG. 15) which extend outwardly from a necked down portion 99 adjacent bottom surface 98 on the two sides 100 that face the inside arms 80. The button cams 39 terminate in a flat band 102. The other two sides 104 are flattened from the bottom surface 98 to the end of push button 38. The sides 104 and the band 102 define a flat rectangular base 106 having an aperture 108 therein to receive one end of the coiled, bias spring 94.

Figure 10:
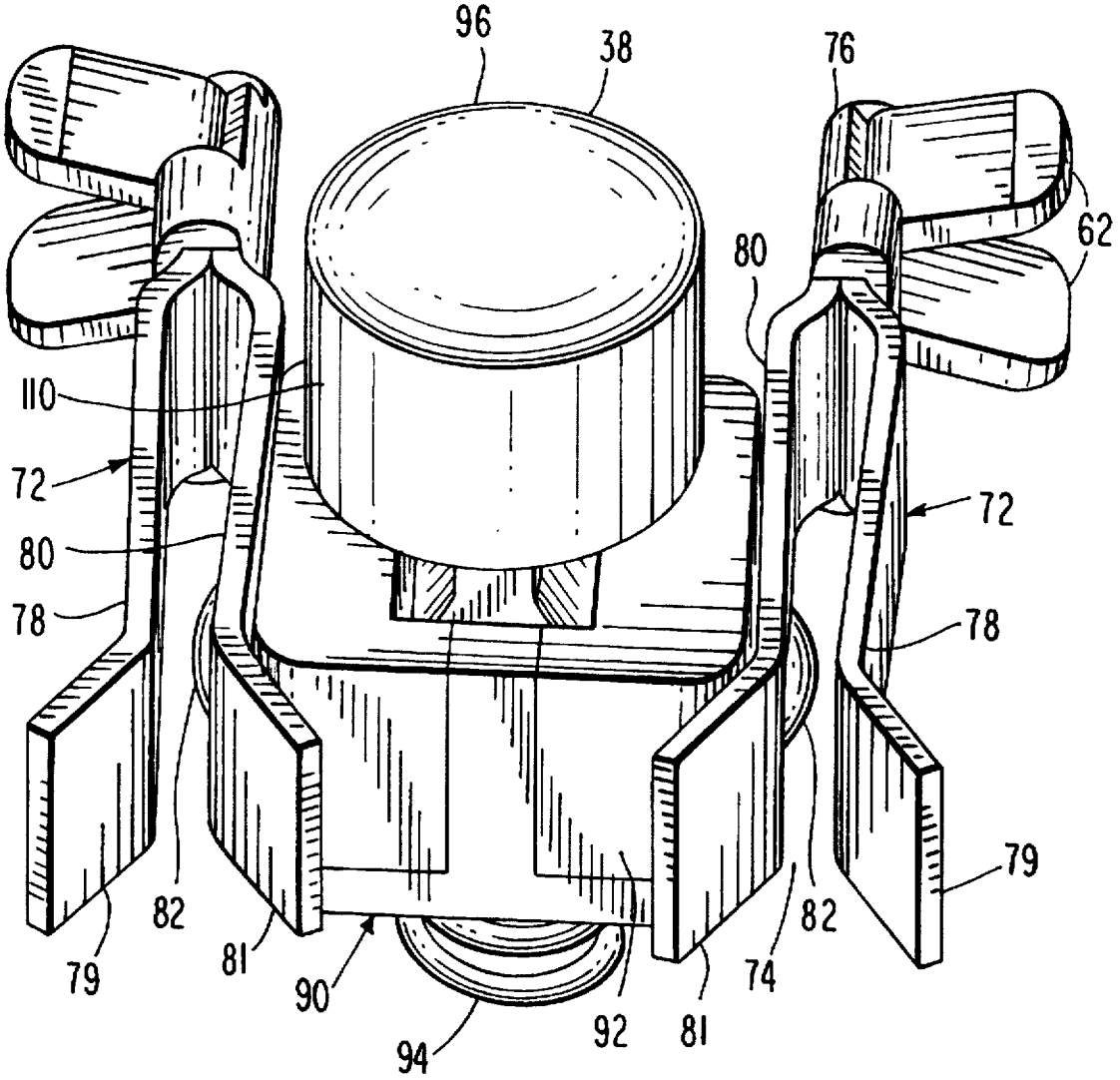
FIG. 10 is a front perspective view of the contacts and button assembly.
Figure 14:
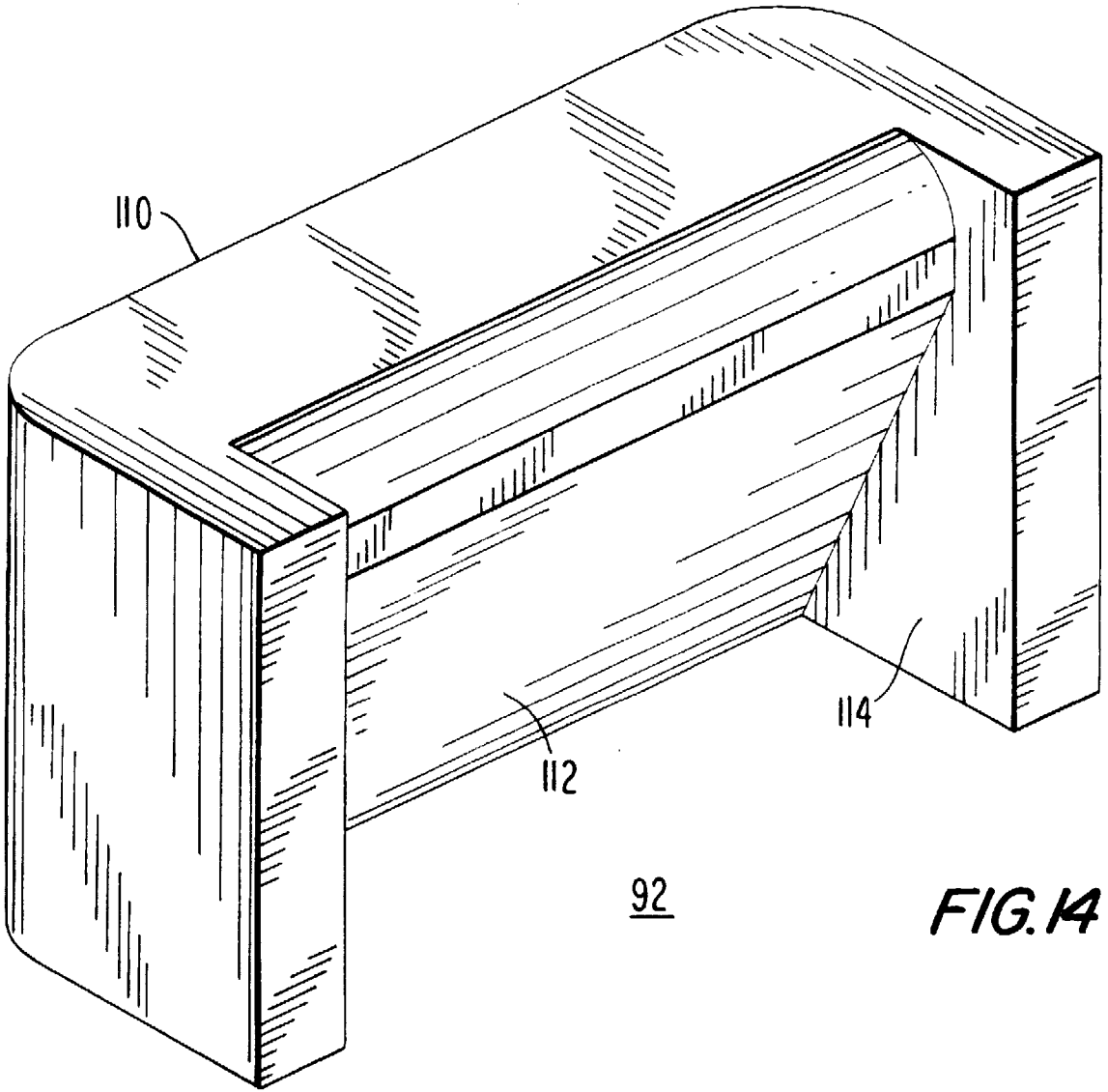
FIG. 14 is a front perspective view of a pusher member from the locking mechanism of FIG. 4.

Pusher members 92 (see FIG. 14) are generally rectangular having a flat outer surface 110 and an inclined inner surface 112. The slope of inner surface 112 is complementary to the slope of the button cams 39 and will ride along such cams 39 depending upon the position of button 38. Side walls 114 retain the pusher members 92 in their positions adjacent the button cams 39. As is shown in FIG. 10 the flat outer surfaces 110 of the pusher members 92 engage inside arms 80 to each side of the push button assembly 90.

Figure 13:
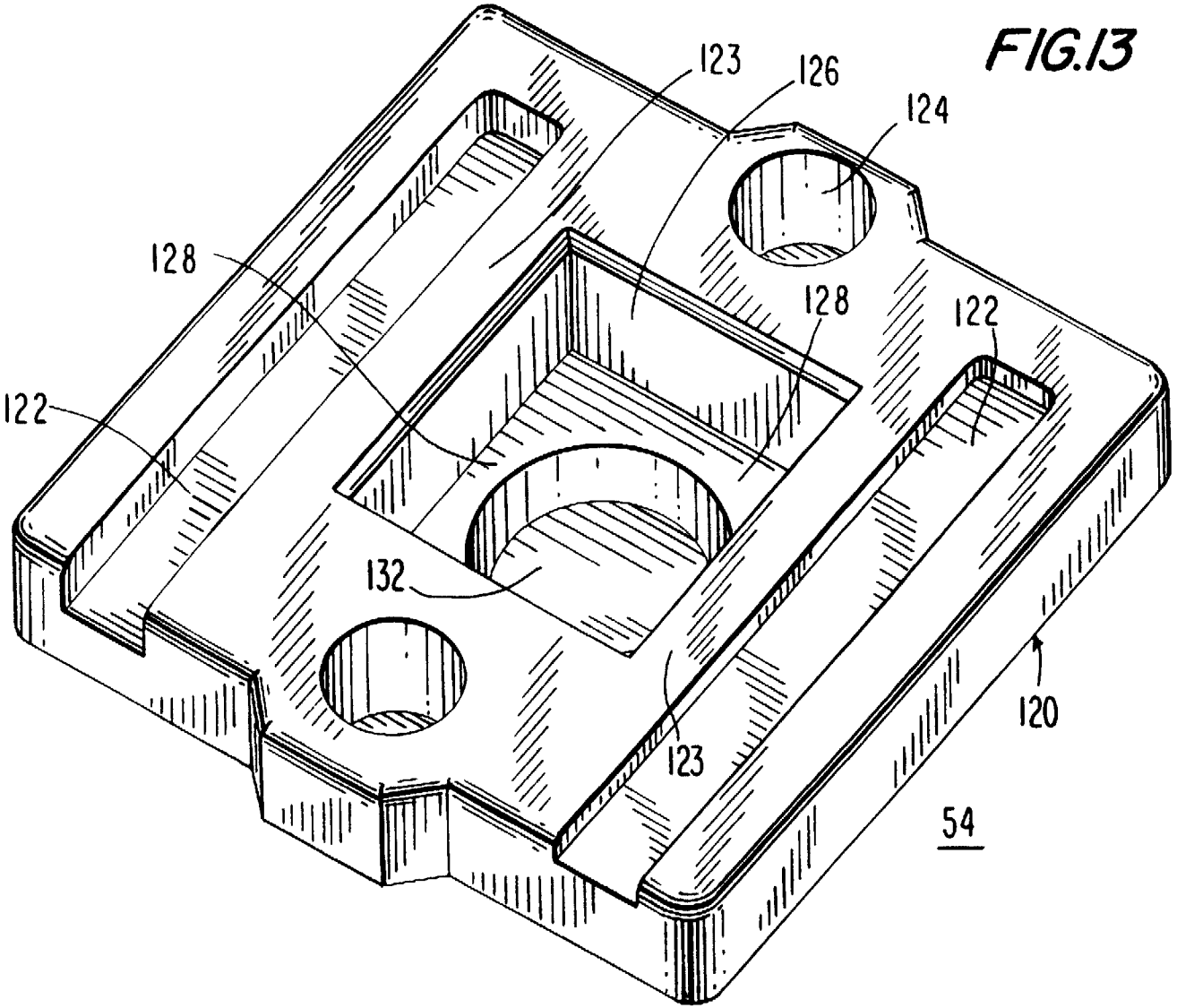
FIG. 13 is a front perspective view of the lower body portion of the locking mechanism.

Lower housing portion 54 (see FIG. 13) is made up of a generally flat plate 120 having two recesses 122 which combine with upper housing portion 52 slots to define the slots 58. Apertures 124 permit the fasteners 64 to extend through plate 120. A rectangular recess 126 extends through plate 120 and is dimensioned to receive end 106 and flat band 102 of the button 38. A metal plate 128 is held in position against the bottom surface of lower housing portion 54 by the fasteners 64 (see FIG. 5). Metal plate 128 has a truncated pyramidal portion 130 in its center and in the center of the portion 130 is a depression 132 to receive the free end of bias spring 94.

Figure 8:
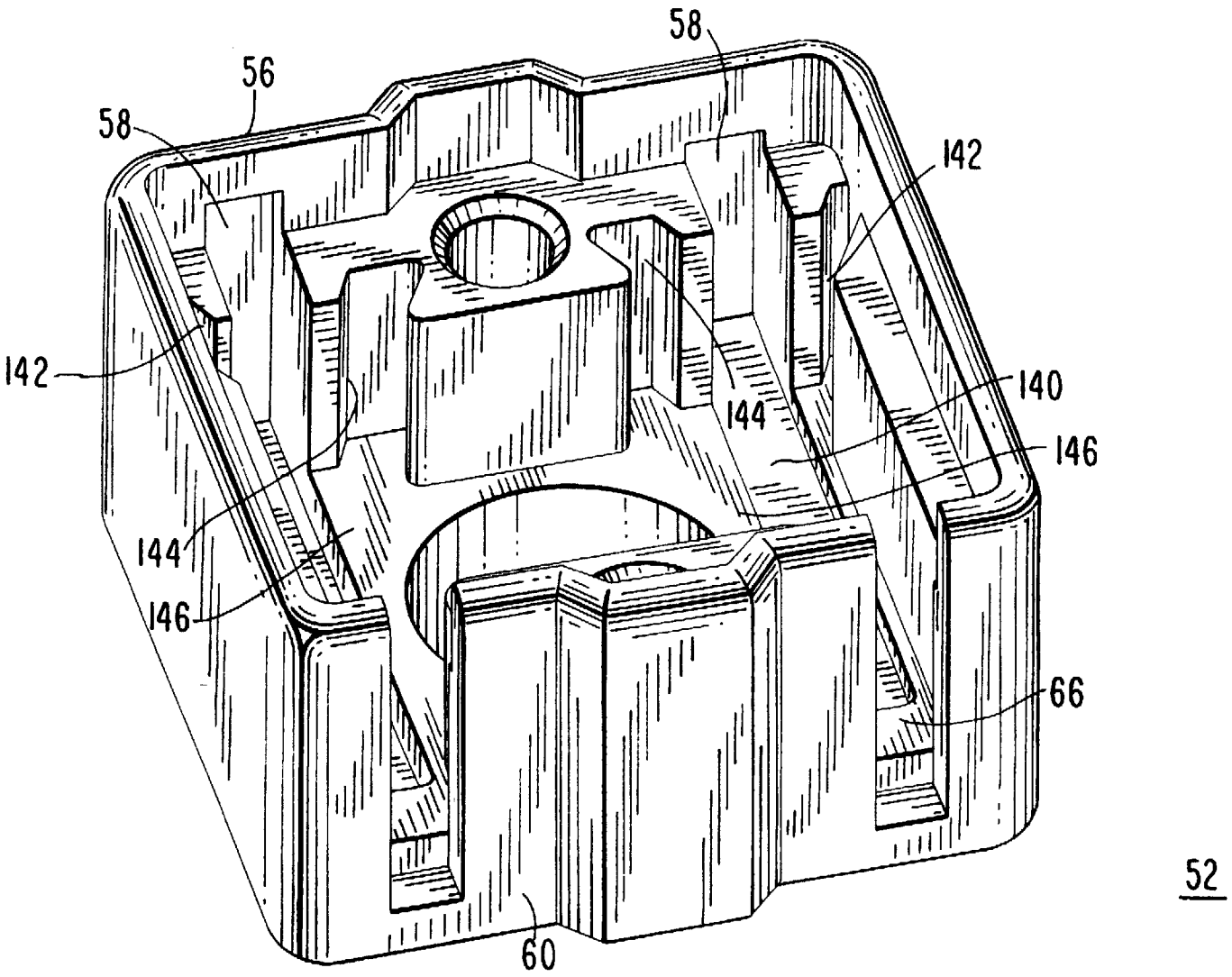
FIG. 8 is a top perspective view of the upper body portion of the locking mechanism inverted to show interior details.
Figure 9:
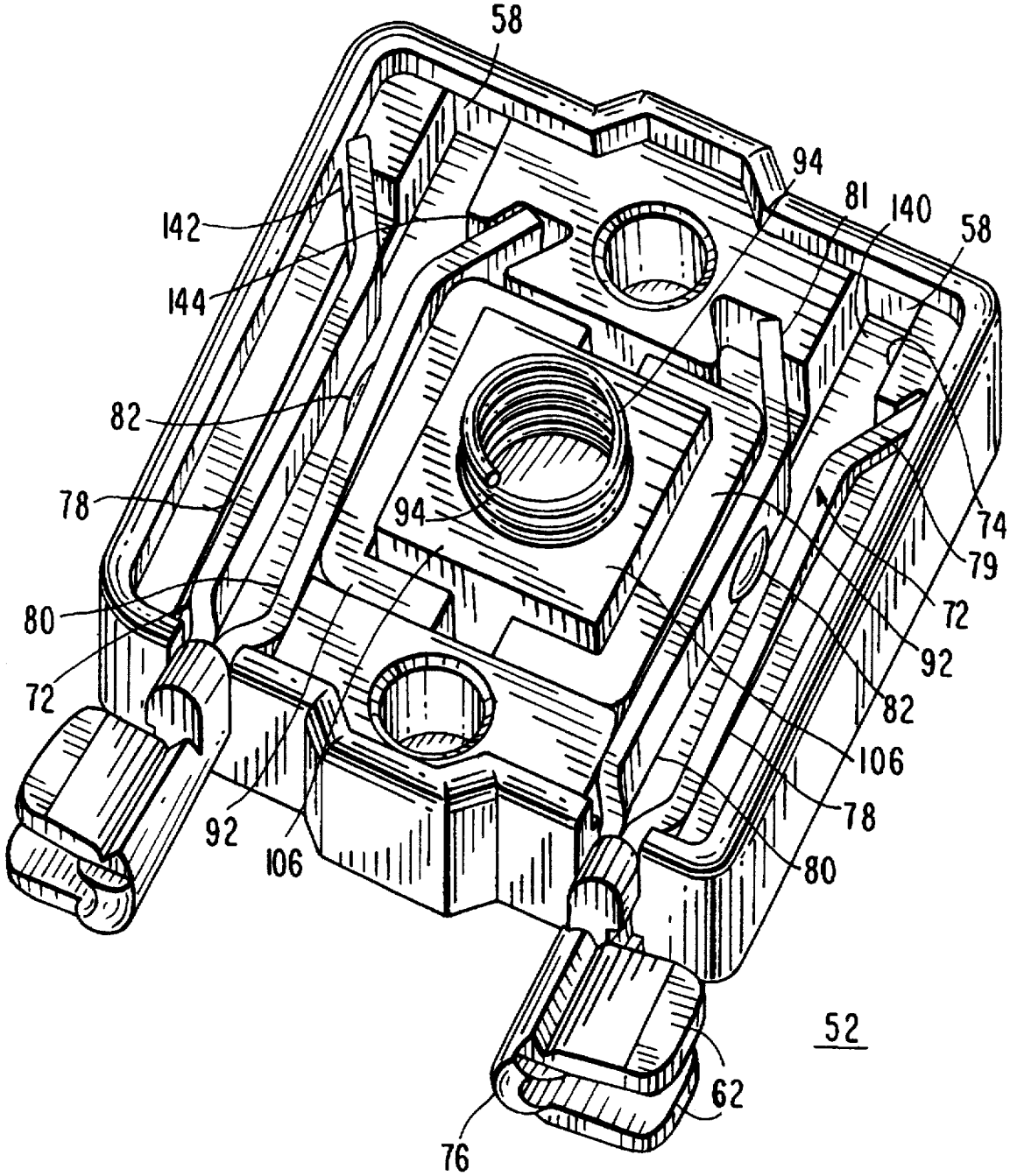
FIG. 9 is a top perspective view of the upper body portion of the locking mechanism inverted, as shown in FIG. 8, with the contacts and button assembly installed.

Turning now to FIGS. 8 and 9 the details of the upper housing portion 52 and of the assembly of contacts 72 with housing portion 52 is shown. Both figures show the interior of portion 52 which is inverted. Extending through front face 56 are two slots 58 for the two blades of a male plug (not shown). A recess 140 is shown extending from each of the slots 58 and which cooperates with a similar recess 122 in lower housing portion 54 to position the inserted blades of a male plug in the complete housing and between the arms 78 and 80, respectively. The conductor receiving ends 62 will extend through the slots 66 in rear face 60. The outwardly extending ends 79 of arms 78 are positioned in slots 142 which together with the position of the joint 73 between the arms 78, 80, respectively, fixes the position of arms 78. The outwardly extending arms 81 of arms 80 are positioned in slots 144 which together with the position of the joint 73 between the arms 78, 80, respectively, fixes the position of the arms 80. The arms 80 are, however, free to flex so that the projections 82 can be moved towards and away from the arms 78. The openings 146 provide access by the pusher member 92 to the arms 80.

Figure 11:
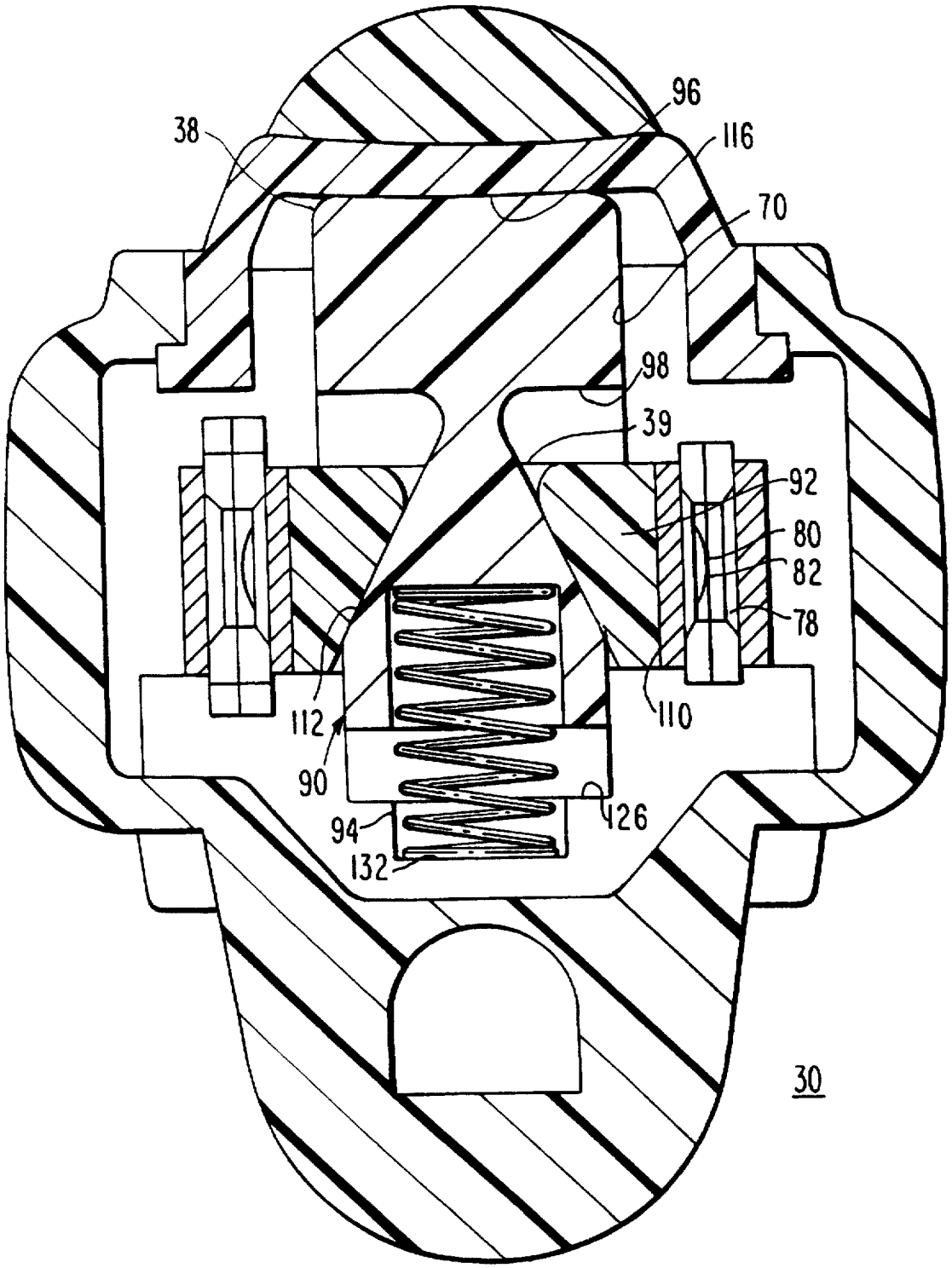
FIG. 11 is a front elevation, in section, of the connector of FIG. 2 taken along the line 11—11 showing the components in their positions when the locking mechanism is locked.
Figure 12:
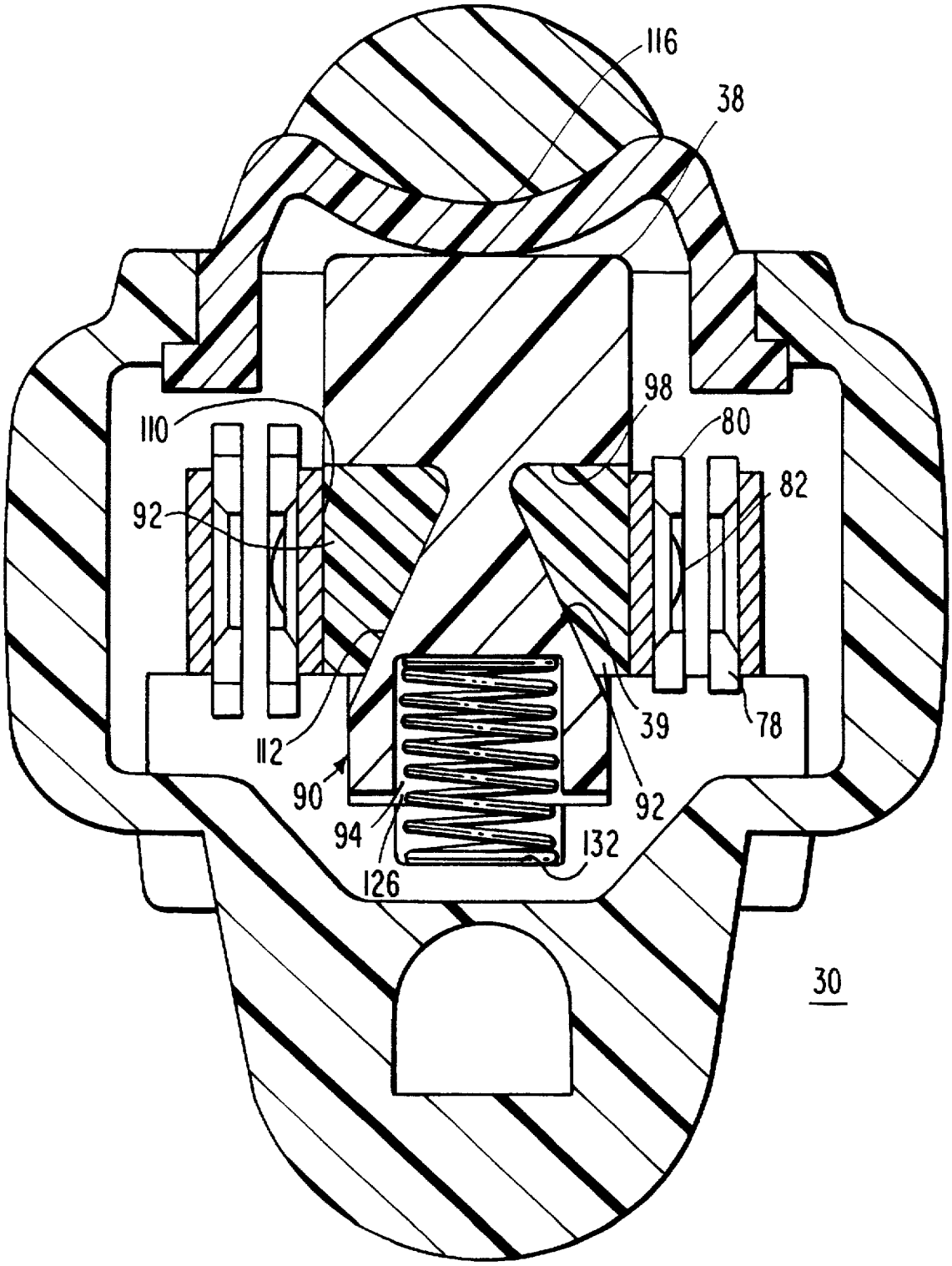
FIG. 12 is the same as FIG. 11 except with the components in their positions when the locking mechanism is open.

Referring now to FIGS. 11 and 12, the operation of the locking mechanism 50 can be appreciated. The view is looking into the connector 30, sectioned at the line 11—11 in FIG. 2. An environmental seal 116 has been added over button 38 to seal the bore 70 and no blades 24 of a male plug 20 are shown to make the drawings easier to comprehend. With no downward force on surface 96 of button 38 the biasing compression spring 94 holds the push button assembly 90 in the position shown in FIG. 11. The push button cams 39 are at their maximum width position with respect to the pusher members 92. That is, the tops of the pusher members 92 are spaced from the bottom surface 98 of push button 38. This causes the pusher members 92 to have a maximum displacement from the longitudinal axis of the push button 38, which in turn causes the flat outer surfaces 110 of pusher members 92 to urge arms 80 towards arms 78 decreasing the spacing between the projections 82 and arms 78 and inserting the projections 82 in the blade holes 28. If blades 24 were inserted between the arms 78, 80, such blades 24 would be firmly held in position making it very difficult to separate the male plug 20 from the female connector 30. This is the locked state of the locking mechanism 50.

In order to release the grip on inserted blades 24 or to open the locking mechanism 50 for the admission of blades 24 between arms 78 and 80, the button 38 must be depressed as shown in FIG. 12. The environmental seal 116 distorts as the button 38 is depressed through the seal 116. As a result the entire button 38 is forced downwardly compressing the bias spring 94 until the surface 106 bottoms out in the rectangular recess 126 against the top surface of the metal plate 128. The button cams 39 are also forced downwardly to position the ends of the button cams 39 adjacent necked down portion 99 next to the inner surfaces 112 of the pusher members 92. This movement creates a gap between the inner surfaces 112 of the pusher members 92 and the button cams 39. Since the arms 80 are resilient and no longer restrained, the arms 80 move outwardly towards the button cams 39 and engage flat outer surfaces 110 of the pusher members 92 forcing them into contact with the button cams 39. This separates the arms 78 and 80 sufficiently to release the projections 82 from contact with an inserted blade 24 or provides sufficient space for a blade to be inserted between the projections 82 and the arms 78. The pusher members 92 are supported on and can be moved along the face 123 of the lower housing portion 120 adjacent the slots 122.

Once a blade 24 has been moved into or out of the locking mechanism 50, the button 38 can be released and the expanding compression bias spring 94 returns the push button assembly 90 to the state shown in FIG. 11.

While there have been shown and described and pointed out the fundamental novel features of the invention as applied to the preferred embodiment, as is presently contemplated for carrying them out, it will be understood that various omissions and substitutions and changes of the form and details of the device illustrated and in its operation may be made by those skilled in the art, without departing from the spirit of the invention.

I claim:

1. A selectively locking female connector for connecting two electrical conductors together, comprising:

a) a first housing portion having a top surface, a substantially open bottom surface, a front surface, a rear surface and two side surfaces; said front surface, said rear surface and said two side surfaces and said top surface joined to form a substantially closed structure open at said bottom surface, at least two first slots in said front surface to receive two blades of a male electrical plug to be inserted into said locking female connector and two second slots in said rear surface;

b) a second housing portion having an exterior surface an interior surface and positionable over said first housing portion bottom surface to close said bottom surface;

c) two stationary internal contacts, each having a bifurcated first end providing a first arm and a second arm and two tabs at a second end, said first and second arms positioned adjacent an associated one of said first slots in said front surface of said first housing portion to receive therebetween an associated blade of a male electrical plug, said two tabs of said second end, each connected to an associated conductor of a two conductor electrical cord; and d) actuator means in said first housing portion, said actuator means having a first position to permit each of said first and second arms to engage an associated blade of an inserted male electrical plug to prevent its withdrawal from between said first and second arms, and a second position to remove the engagement between said first and second arms and an inserted male blade to permit such male blade to be removed or inserted between an associated first and second arms.

2. A selectively locking female connector, as defined in claim 1, further comprising:

a) a projection on each of said two second arms to each engage a punched hole in each of said two male blades inserted into said internal contacts bifurcated first end to thereby hold said male blades in said associated bifurcated first end.

3. A selectively locking female connector, as defined in claim 1, further comprising:

a) two pusher members, one associated with each of said second arms to engage an associated second arm and control the position of said second arm; and b) said actuator means positioned between each of said two pusher members to control the position of said pusher members.

4. A selectively locking female connector, as defined in claim 2, further comprising:

a) two pusher members, one associated with each of said second arms to engage an associated second arm and control the position of said second arm; and b) said actuator means positioned between each of said two pusher members to control the position of said pusher members.

5. A selectively locking female connector, as defined in claim 3, wherein said actuator means comprises:

a) a manually operated element being accessible from outside of said first and second housing portion; and b) an actuating element having two opposite, outwardly tapered side walls to engage said pusher members.

6. A selectively locking female connector, as defined in claim 1, wherein said actuator means further comprises:

a) bias means positioned between said second housing portion and said actuator means to maintain said actuator means in said first position and return said actuator means to said first position after said actuator means has been moved to said second position.

7. A selectively locking female connector, as defined in claim 2, wherein said actuator means further comprises:

a) bias means positioned between said second housing portion and said actuator means to maintain said actuator means in said first position and return said actuator means to said first position after said actuator means has been moved to said second position.

8. A selectively locking female connector, as defined in claim 5, wherein said actuator means further comprises:

a) bias means positioned between said second housing portion and said actuator means to maintain said actuator means in said first position and return said actuator means to said first position after said actuator means has been moved to said second position.

9. A selectively locking female connector, as defined in claim 5, wherein said pusher members each comprising an exterior surface and an interior surface;

said interior surface outwardly tapered complementary to said actuating element whereby the force exerted upon said associated second arms is dependent upon the position of said actuating element side walls with respect to said pusher members interior surfaces.

10. A selectively locking female connector as defined in claim 9, further comprising:

a) bias means positioned between said second housing portion and said actuator means to maintain said actuator means in said first position and return said actuator means to said first position after said actuator means has been moved to said second position.

11. A locking female electrical connector comprising:

a) a female connector body having a pair of apertures for receiving the spaced apart blades, having punched holes, of a male plug for electrically connecting two electrical conductors, respectively, coupled to said female connector body and said plug;

b) said female connector body having means to actuate mounted for selective relative movement within said connector body;

c) said means to actuate having a manually operated element being accessible from the outside of said female connector body;

d) two stationary electrical contacts in said female connector body having a bifurcated first end defining two spaced arms, one stationary electrical contact adjacent each of said pair of apertures;

e) a pair of locking elements, one for each of said two electrical contacts, on one of each said two spaced arms, in operative relationship to said means to actuate at a position between the spaced contacts for selectively engaging the punched holes of male plug blades inserted into said female connector body locking the blades of a male plug inserted into said female connector body;

f) said means to actuate being movable to a first position between said spaced stationary contacts for permitting insertion and removal of said blades relative to said locking elements; and g) said means to actuate being movable to a second position between said spaced stationary contacts in said female connector body for simultaneously urging said pair of locking elements outwardly in opposite directions into locking contact with the blades of said male plug.

12. A female connector, as defined in claim 11, further comprising means to bias for urging said means to actuate to said second position.

13. A female connector, as defined in claim 11, wherein said means to activate further comprises:

a) an extension having two side walls which taper outwardly towards the bottom of said extension, said extension being movable in said connector body and being operative to contact said electrical contacts arms having said locking elements thereon by means of a pusher element.

* * * * *